US007703577B1

(12) United States Patent
Zach et al.

(10) Patent No.: US 7,703,577 B1
(45) Date of Patent: Apr. 27, 2010

(54) DOOR HINGE LUBRICATOR

(76) Inventors: Marco J. Zach, 7715 W Cheverny Dr., Mequon, WI (US) 53097; Jon A. DeBoer, 3709 E. Norport Dr., Port Washington, WI (US) 53074

( * ) Notice: Subject to any disclaimer, the term of this patent is extended or adjusted under 35 U.S.C. 154(b) by 123 days.

(21) Appl. No.: 12/016,557

(22) Filed: Jan. 18, 2008

(51) Int. Cl.
*E05D 11/00* (2006.01)
*E05D 11/02* (2006.01)
*E05D 11/06* (2006.01)

(52) U.S. Cl. ..... 184/6.19; 184/102; 184/104.1; 16/272; 16/274; 16/375; 16/386

(58) Field of Classification Search ..... 184/6.19, 184/16–25, 102; 16/223, 273, 274–276, 16/320, 380, 250–251; *E05D 11/02*
See application file for complete search history.

(56) References Cited

U.S. PATENT DOCUMENTS 2,053,864 A * 9/1936 Cook et al. ..... 16/274
2,485,998 A * 10/1949 Bales ..... 184/102
2,570,942 A * 10/1951 Hadfield ..... 16/274
5,114,205 A * 5/1992 Jee ..... 296/152
2007/0157432 A1* 7/2007 Weinstein ..... 16/320

* cited by examiner

*Primary Examiner*—Robert A Siconolfi
*Assistant Examiner*—San Aung
(74) *Attorney, Agent, or Firm*—Donald J. Ersler

(57) ABSTRACT

A door hinge lubricator includes a tube, a wicking material and at least one attachment device. At least one lubrication opening is formed through a wall of the tube. Each lubrication opening could be a hole or a slot. The wicking material is inserted into an inner perimeter of the tube. The wicking material is saturated with a lubricant, such as oil. Each end of the tube is sealed with an end plug or the like. The at least one attachment device is preferably attached substantially in-line with the at least one lubrication opening. It is preferable to place the single attachment device on each end of the tube. The door hinge lubricator is attached to one of the hinge plates, adjacent the hinge pin. Lubricant will be wicked into the joints between the opposing hinge plates. After a door hinge stops squeaking, the door hinge lubricator may be removed.

18 Claims, 3 Drawing Sheets

DOOR HINGE LUBRICATOR

BACKGROUND OF THE INVENTION

1. Field of the Invention

The present invention relates generally to lubrication of door hinges and more specifically to a door hinge lubricator, which may be easily secured to a door hinge for the lubrication thereof.

2. Discussion of the Prior Art

The prior art teaches filling hinge pins with a lubricant and placing bushings between mating hinge plates. However, it appears that the prior art does not teach or suggest retaining an external device, adjacent a door hinge for the lubrication thereof.

Accordingly, there is a clearly felt need in the art for a door hinge lubricator, which may be easily attached to a door hinge for lubrication and easily removed from the door hinge.

SUMMARY OF THE INVENTION

The present invention provides a door hinge lubricator, which may be easily attached to a door hinge for the lubrication thereof. The door hinge lubricator includes a tube, a wicking material and at least one attachment device. At least one lubrication opening is formed through a wall of the tube. Each lubrication opening could be a hole or a slot. The wicking material is inserted into an inner perimeter of the tube. The wicking material is saturated with a lubricant, such as oil. Each end of the tube is sealed with an end plug or the like. The at least one attachment device is preferably attached substantially in-line with the at least one lubrication opening. However, it is preferable to place a single attachment device on each end of the tube. The door hinge lubricator is attached to a pin retaining portion of one of the hinge plates of a door hinge. Lubricant will be wicked into joints between opposing pin retaining portions. After a door hinge stops squeaking, the door hinge lubricator may be removed from the door hinge.

Accordingly, it is an object of the present invention to provide a door hinge lubricator, which may be easily attached to a door hinge for lubrication and easily removed from the door hinge.

These and additional objects, advantages, features and benefits of the present invention will become apparent from the following specification.

DETAILED DESCRIPTION OF THE PREFERRED EMBODIMENTS

Figure 3:
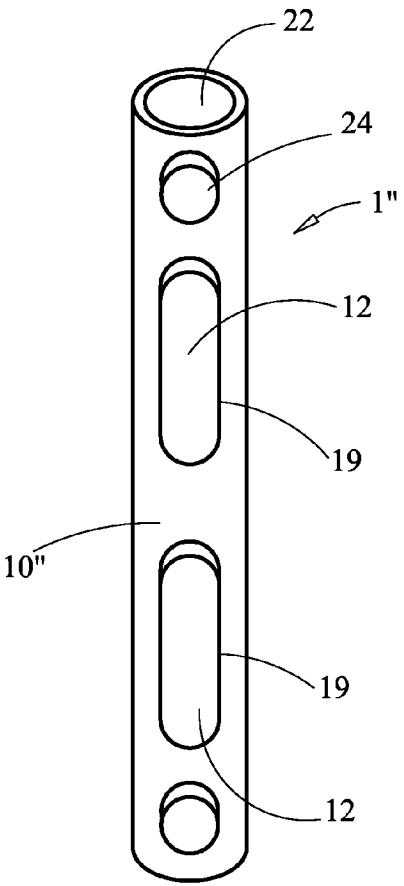
FIG. 3 is a perspective view of a door hinge lubricator with a lengthwise slot lubrication opening in accordance with the present invention.
Figure 2:
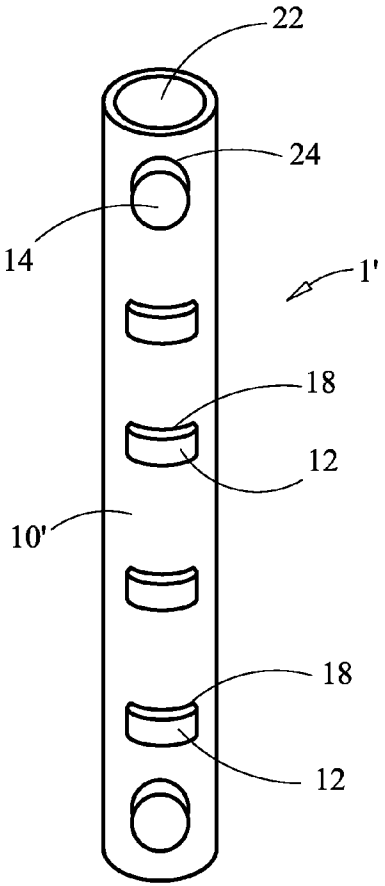
FIG. 2 is a perspective view of a door hinge lubricator with a slot lubrication opening in accordance with the present invention.
Figure 1:
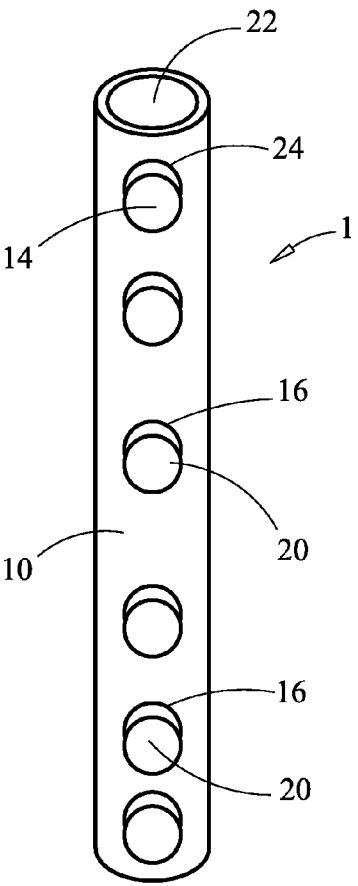
FIG. 1 is a perspective view of a door hinge lubricator in accordance with the present invention.
Figure 5:
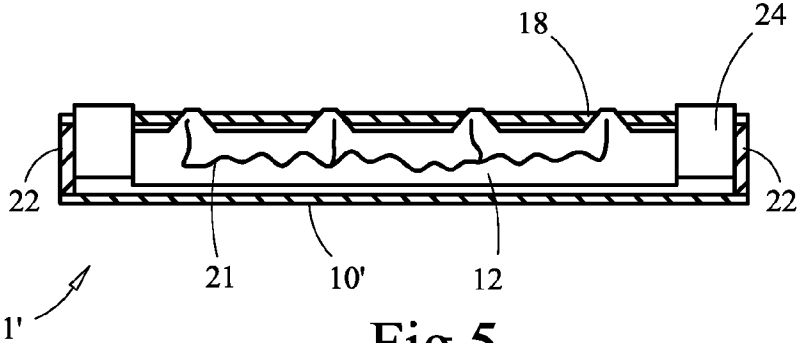
FIG. 5 is a cut-away view of a door hinge lubricator with a slot lubrication opening in accordance with the present invention.

With reference now to the drawings, and particularly to FIG. 1, there is shown a perspective view of a door hinge lubricator 1, 1', 1". With reference to FIGS. 1-5, the door hinge lubricator 1, includes a tube 10, a wicking material 12 and at least one attachment device 14. At least one lubrication opening is formed through a wall of the tube 10. The tube 10 may have the same color as a hinge. Each lubrication opening could be a hole 16, a slot 18 or a lengthwise slot 19. The wicking material 12 is inserted into an inner perimeter of the tube 10. The wicking material 12 is preferably fabricated from any suitable material, which has absorbent and wicking properties. An additional piece of wicking material 20 may be inserted into each lubrication opening 16. However, the wicking material 12 may be allowed to swell out of the lubrication opening as shown in FIG. 5. The wicking material 12, 20 is saturated with a lubricant 21, such as oil. Each end of the tube 12 is sealed with an end plug 22 or any other suitable method, such as epoxy. The end plug 22 may be secured into the inner perimeter of the tube 10; to an outer perimeter of the tube 10; or to an end of the tube 10 with adhesive, sonic welding or any other suitable process. The tube 10 and the end plugs 22 form a case with cavity. However, other structures besides the tube 10 may also be used, such as a square shaped tube, a substantially U-shaped structure or any other suitable structure.

The at least one attachment device 14 is preferably attached substantially in-line with the plurality of openings. It is preferable to locate a single attachment device 14 near each end of the tube 10, 10', 10". The single attachment device 14 is preferably a permanent magnet, but other suitable devices may also be used to retain the hinge door lubricator 1, 1', 1" adjacent a door hinge. The other suitable attachment devices could have limited use, such as double backed tape or repeat use, such as the permanent magnet. A magnet opening 24 may be formed in the tube 10, 10', 10" to receive the attachment device 14 and secured with adhesive or any suitable process.

Figure 6:
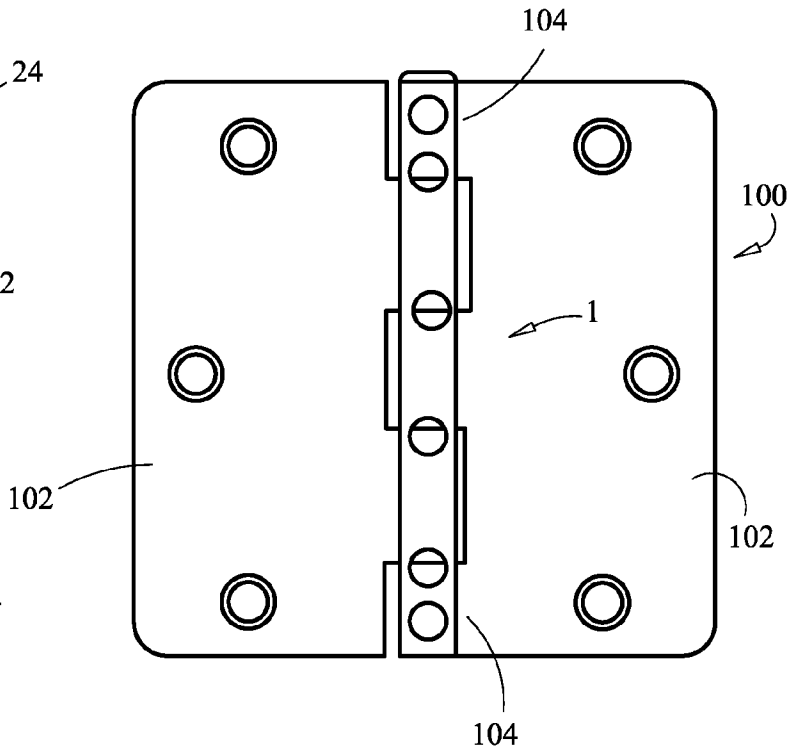
FIG. 6 is a front view of a door hinge lubricator attached to a pin retainer portion of a hinge plate in accordance with the present invention.
Figure 4:
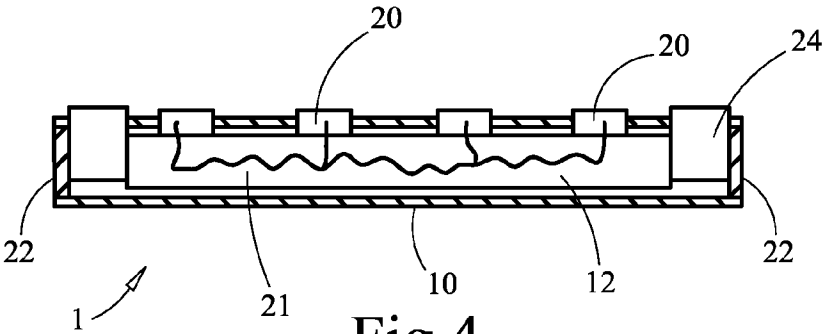
FIG. 4 is a cut-away view of a door hinge lubricator in accordance with the present invention.
Figure 7:
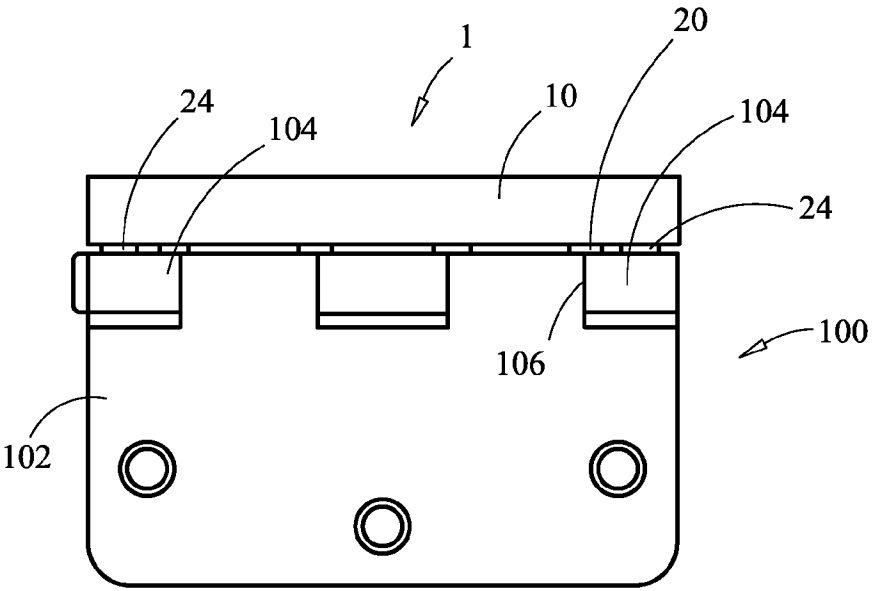
FIG. 7 is a side view of a door hinge lubricator attached to a pin retainer portion of a hinge plate in accordance with the present invention.

With reference to FIGS. 6-7, the door hinge lubricator 1, 1', 1" is attached to a pin retaining portion 104 of one of the hinge plates 102 of a door hinge 100. The at least one lubrication opening 16, 18, 19 are located in the tube 10, such that the at least one lubrication opening 16, 18, 19 are substantially aligned with joints 106 between the pin retaining portions 104. Lubricant 21 contained in the wicking material 12, 20 will be wicked into joints 106 between the pin retaining portions 104 of opposing hinge plates 102 through capillary action. After the door hinge 100 stops squeaking, the door hinge lubricator 1, 1', 1" may be removed from the door hinge 100.

Figure 8:
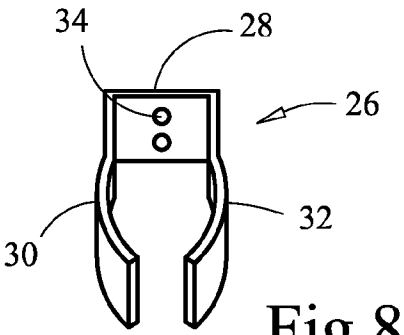
FIG. 8 is a perspective view of a retention clip for retaining a door hinge lubricator on a pin retainer portion of a hinge plate in accordance with the present invention.
Figure 9:
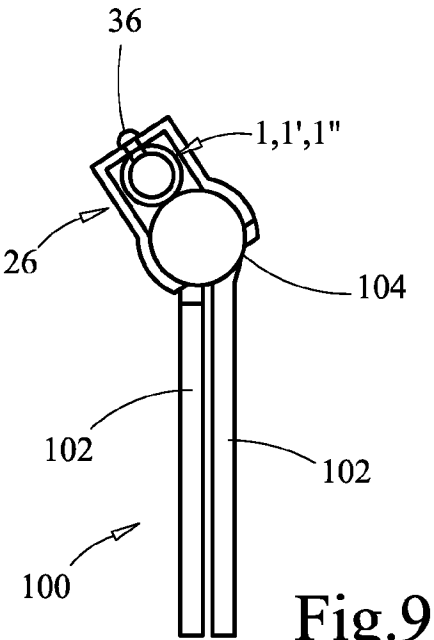
FIG. 9 is a top view of a retention clip secured to a door hinge lubricator and retained on a pin retainer portion of a hinge plate in accordance with the present invention.

With reference to FIGS. 8-9, a retention clip 26 is used to attach the door hinge lubricator 1, 1', 1" to one of the pin retaining portions 104 of the hinge 100. The retention clip 26 includes a base portion 28, a first retaining arm 30 and a second retaining arm 32. The first retaining arm 30 extends from one end of the base portion 28 and the second retaining arm 32 extends from the other end of the base portion 28. A portion of the first and second arms are preferably sized and shaped to firmly receive a perimeter of one of the pin retaining portions 104. The door hinge lubricator 1, 1', 1" may be retained in the retention clip 26 by inserting a pin 36 or the like through a hole 34 and into the door hinge lubricator 1, 1', 1". However, other types or designs of clips may also be used to retain the door hinge lubricator 1, 1', 1" on a door hinge.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A door hinge lubricator in combination with a door hinge, comprising:

a door hinge having two hinge plates each one of the two hinge plates having a pin retaining portion;

a case having a cavity;

a wicking material for retaining a quantity of lubricant, said wicking material being retained in said cavity;

at least one opening being formed through said case, said wicking material extending into said at least one opening in said case and to at least an outer wall of said case; and means for retaining said wicking material in contact with the two pin retaining portions of the door hinge.

2. The door hinge lubricator in combination with a door hinge of claim 1 wherein:

said wicking material being saturated with said quantity of lubricant.

3. The door hinge lubricator in combination with a door hinge of claim 1 wherein:

locating said at least one opening to align with a plurality of joints between pin retaining portions of the door hinge.

4. The door hinge lubricator in combination with a door hinge of claim 1 wherein:

a magnet being said means for retaining said case adjacent to a door hinge.

5. The door hinge lubricator in combination with a door hinge of claim 1 wherein:

each one of said at least one opening having a round shape.

6. The door hinge lubricator in combination with a door hinge of claim 1 wherein:

each one of said at least one opening being a slot.

7. The door hinge lubricator in combination with a door hinge of claim 1 wherein:

inserting a second wicking material into each one of said at least one opening.

8. A door hinge lubricator in combination with a door hinge comprising:

a door hinge having two hinge plates each one of the two hinge plates having a pin retaining portion;

a case having a cavity;

a wicking material for retaining a quantity of lubricant, said wicking material being retained in said cavity;

at least one opening being formed through said case, said wicking material extending into said at least one opening in said case and to at least an outer wall of said case, locating said at least one opening to align with a plurality of joints between pin retaining portions of the door hinge; and means for retaining said wicking material in contact with the two pin retaining portions of the door hinge.

9. The door hinge lubricator in combination with a door hinge of claim 8 wherein:

said wicking material being saturated with said quantity of lubricant.

10. The door hinge lubricator in combination with a door hinge of claim 8 wherein:

a magnet being said means for retaining said case adjacent to a door hinge.

11. The door hinge lubricator in combination with a door hinge of claim 8 wherein:

each one of said at least one opening having a round shape.

12. The door hinge lubricator in combination with a door hinge of claim 8 wherein:

each one of said at least one opening being a slot.

13. The door hinge lubricator in combination with a door hinge of claim 8 wherein:

inserting a second wicking material into each one of said at least one opening.

14. A door hinge lubricator in combination with a door hinge comprising:

a door hinge having two hinge plates each one of the two hinge plates having a pin retaining portion;

a case having a cavity;

a wicking material for retaining a quantity of lubricant, said wicking material being retained in said cavity;

at least one opening being formed through said case, inserting at least one second wicking material into each one of said at least one opening, said at least one second wicking material communicating with said wicking material; and means for retaining said wicking material in contact with the two pin retaining portions of the door hinge.

15. The door hinge lubricator in combination with a door hinge of claim 14 wherein:

locating said at least one opening to align with a plurality of joints between pin retaining portions of the door hinge.

16. The door hinge lubricator in combination with a door hinge of claim 14 wherein:

a magnet being said means for retaining said case adjacent to a door hinge.

17. The door hinge lubricator in combination with a door hinge of claim 14 wherein:

each one of said at least one opening having a round shape.

18. The door hinge lubricator in combination with a door hinge of claim 14 wherein:

each one of said at least one opening being a slot.

* * * * *